US008297610B2

(12) United States Patent
Shiraishi

(10) Patent No.: US 8,297,610 B2
(45) Date of Patent: Oct. 30, 2012

(54) IMAGE FORMING APPARATUS AND IMAGE FORMING METHOD

(75) Inventor: Ryuuichi Shiraishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 41 days.

(21) Appl. No.: 13/048,525

(22) Filed: Mar. 15, 2011

(65) Prior Publication Data

US 2012/0018943 A1 Jan. 26, 2012

(30) Foreign Application Priority Data

Jul. 21, 2010 (JP) ..... 2010-163704

(51) Int. Cl.
*B65H 37/04* (2006.01)

(52) U.S. Cl. ..... 270/58.09; 270/58.08; 270/58.11

(58) Field of Classification Search ..... 270/58.08, 270/58.09, 58.11, 58.12, 58.16, 58.17
See application file for complete search history.

(56) References Cited

U.S. PATENT DOCUMENTS 4,595,509 A * 6/1986 Fox et al. ..... 210/665
5,642,876 A * 7/1997 Ferrara et al. ..... 270/58.01
5,899,841 A 5/1999 Berger
6,550,757 B2 * 4/2003 Sesek ..... 270/58.09
2010/0019435 A1 * 1/2010 Fukami ..... 270/58.11
2011/0222945 A1 * 9/2011 Sato ..... 399/408
2011/0304089 A1 * 12/2011 Kimura ..... 270/58.08

FOREIGN PATENT DOCUMENTS

JP 3885410 B2 11/2000
JP 4044416 B2 6/2004

* cited by examiner

*Primary Examiner* — Patrick Mackey
(74) *Attorney, Agent, or Firm* — Sughrue Mion, PLLC

(57) ABSTRACT

An image forming apparatus includes an image forming unit that forms images on sheets; a stack portion on which the sheets with the images are stacked as a bundle of the sheets with first end parts of the sheets aligned; a first binding unit that binds the first end parts; a second binding unit that binds the first end parts, by a binding method that requires a binding region larger than that of the first binding unit; and a distance reducing unit that changes a position of the bundle when bound by the first binding unit, from a position of the bundle when bound by the second binding unit, and reduces a distance between a part bound by the second binding unit and the first end parts as compared with a distance between a part bound by the first binding unit and the first end parts.

17 Claims, 11 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2010-163704 filed Jul. 21, 2010.

BACKGROUND

The present invention relates to an image forming apparatus and an image forming method.

SUMMARY

According to an aspect of the invention, there is provided an image forming apparatus including an image forming unit that forms images on sheets; a stack portion on which the sheets with the images formed by the image forming unit are stacked as a bundle of the sheets such that first end parts of the sheets are aligned; a first binding unit that binds the first end parts of the bundle of sheets stacked on the stack portion; a second binding unit that binds the first end parts of the bundle of sheets stacked on the stack portion, by a binding method that requires a binding region larger than a binding region of the first binding unit; and a distance reducing unit that changes a position of the bundle of sheets when the bundle of sheets is bound by the first binding unit, from a position of the bundle of sheets when the bundle of sheets is bound by the second binding unit, and reduces a distance between a part bound by the second binding unit and the first end parts as compared with a distance between a part bound by the first binding unit and the first end parts.

BRIEF DESCRIPTION OF THE DRAWINGS

Exemplary embodiment(s) of the present invention will be described in detail based on the following figures, wherein.

DETAILED DESCRIPTION

Embodiments of the present invention will be described below in detail with reference to the accompanying drawings.

Image Forming System 1

Figure 1:
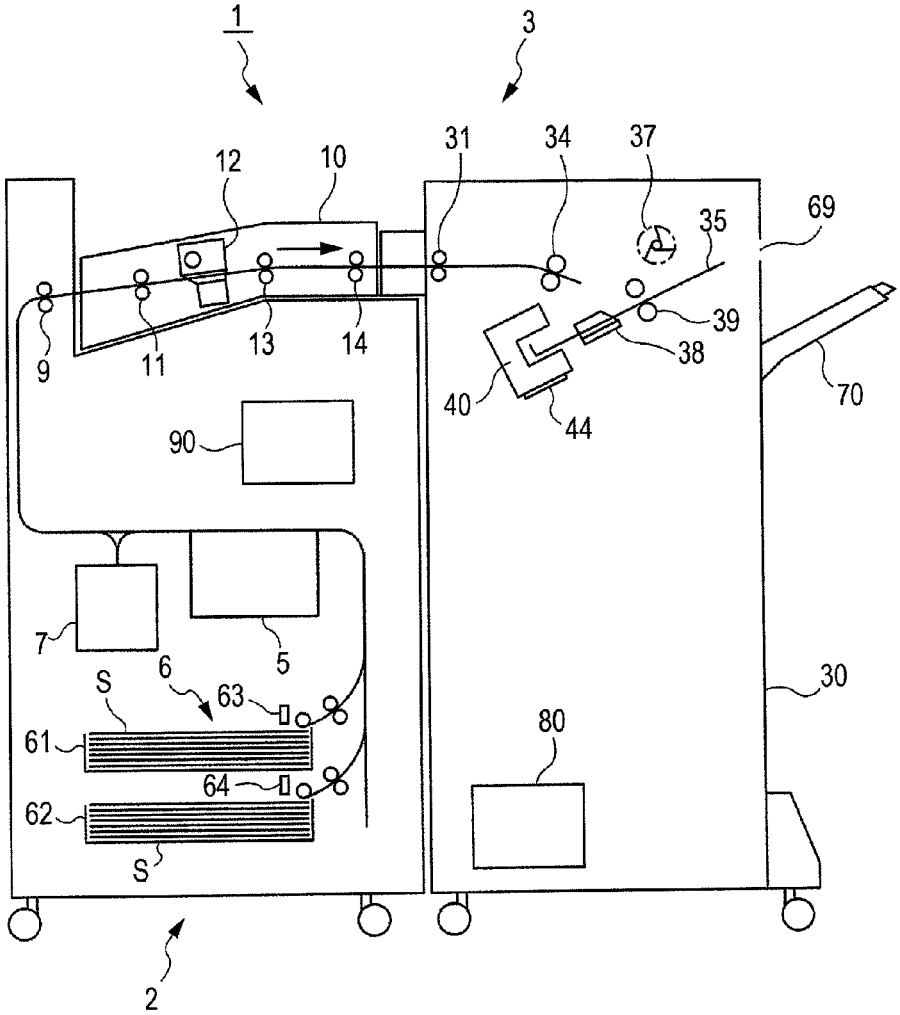
FIG. 1 is a schematic configuration diagram showing an image forming system to which an exemplary embodiment of the present invention is applied.

FIG. 1 is a schematic configuration diagram showing an image forming system 1 to which an exemplary embodiment is applied. The image forming system 1 shown in FIG. 1 includes an image forming apparatus 2, such as a printer or a copier, that forms an image, for example, by an electrophotographic system; and a sheet processing apparatus 3 that performs post-processing for a sheet S, on which, for example, a toner image is formed by the image forming apparatus 2.

Image Forming Apparatus 2

The image forming apparatus 2 includes a sheet supply section 6 that supplies a sheet S, on which an image is formed; and an image forming section 5 that forms an image on the sheet S supplied from the sheet supply section 6. Also, the image forming apparatus 2 includes a sheet reverse device 7 that reverses the surface of the sheet S with the image formed by the image forming section 5; and an output roller 9 that outputs the sheet S with the image formed thereon. Further, the image forming apparatus 2 includes a user interface 90 that receives information relating to binding processing from a user.

It is to be noted that the image forming section 5, which is an example of an image forming unit, may change the position of the image to be formed on the sheet S. That is, a distance between an end of the sheet S to the image to be formed may be changed.

The sheet supply section 6 includes a first sheet-supply stack portion 61 and a second sheet-supply stack portion 62, in which sheets S are stacked and which supply the sheets S to the image forming section 5. Also, the sheet supply section 6 includes a first sheet-supply sensor 63 that is provided in the first sheet-supply stack portion 61 and detects the presence of a sheet S; and a second sheet-supply sensor 64 that is provided in the second sheet-supply stack portion 62 and detects the presence of a sheet S.

Sheet Processing Apparatus 3

The sheet processing apparatus 3 includes a transport device 10 that transports the sheet S output from the image forming apparatus 2 to a further downstream side; and a post-processing device 30 including, for example, a compiling stack portion 35 that collects and groups sheets S and a binding device 40 that binds end parts of the sheets S. Also, the sheet processing apparatus 3 includes a controller 80 that controls the entire image forming system 1.

The transport device 10 of the sheet processing apparatus 3 includes an entrance roller 11 including a pair of rollers that receive the sheet S output through the output roller 9 of the image forming apparatus 2; and a puncher 12 that makes holes if necessary in the sheet S received by the entrance roller 11. Also, the transport device 10 includes a first transport roller 13 provided further downstream of the puncher 12 and including a pair of rollers that transport the sheet S to the downstream side; and a second transport roller 14 including a pair of rollers that transport the sheet S toward the post-processing device 30.

The post-processing device 30 of the sheet processing apparatus 3 includes a receive roller 31 including a pair of rollers that receive the sheet S from the transport device 10. Also, the post-processing device 30 includes the compiling stack portion 35 that is provided downstream of the receive roller 31, collects plural sheets S, and houses the sheets S; and an exit roller 34 including a pair of rollers that output the sheets S toward the compiling stack portion 35.

Also, the post-processing device 30 includes a paddle 37 that rotates to push the sheets S toward an end guide 35*b* (described later) of the compiling stack portion 35. The post-processing device 30 also includes a tamper 38 that aligns ends of the sheets S. The post-processing device 30 further includes an eject roller 39 that transports a bundle of the bound sheets S by pressing the sheets S stacked on the compiling stack portion 35 and by rotating.

Further, the post-processing device 30 includes the binding device 40 that binds the end parts of the bundle of sheets S stacked on the compiling stack portion 35. The post-processing device 30 also includes an opening 69 through which the bundle of sheets S is output to the outside of the post-processing device 30 by the eject roller 39. The post-processing device 30 includes a stack portion 70 in which bundles of sheets S output from the opening 69 are stacked such that the user easily picks up the bundles of sheets S.

Structure Around Binding Unit

Figure 2:
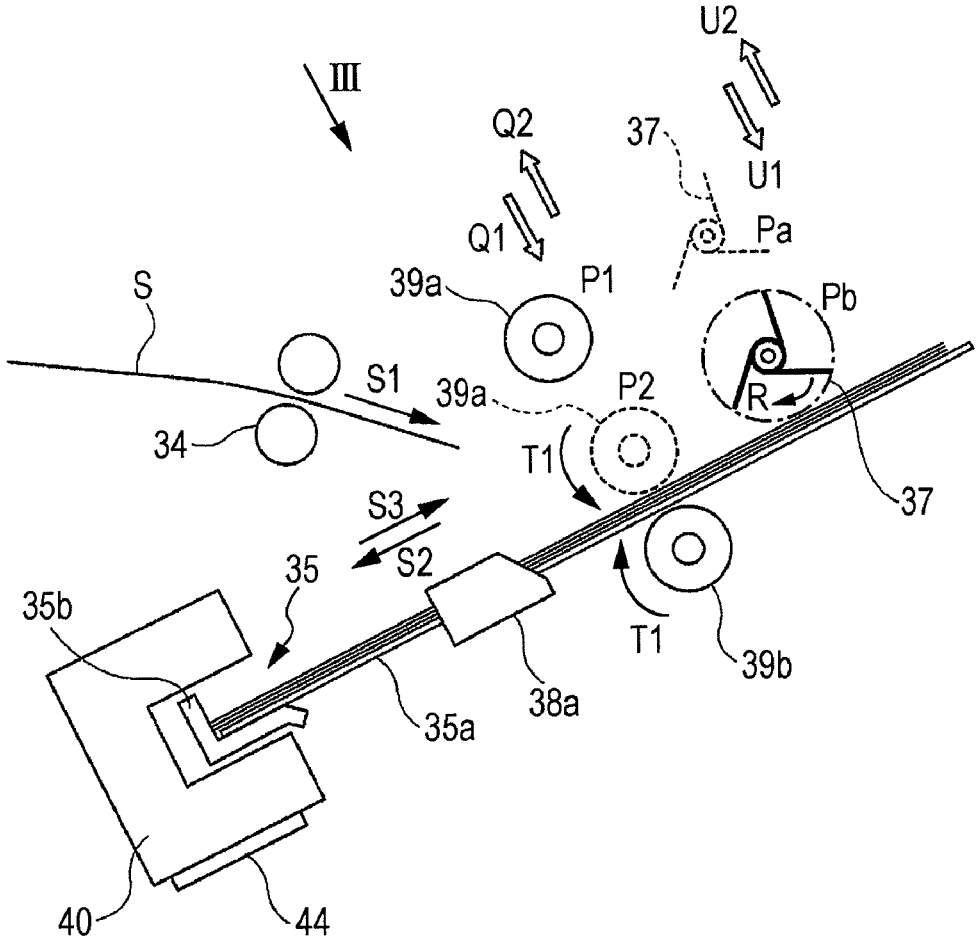
FIG. 2 is a schematic configuration diagram showing the periphery of a compiling stack portion.
Figure 3:
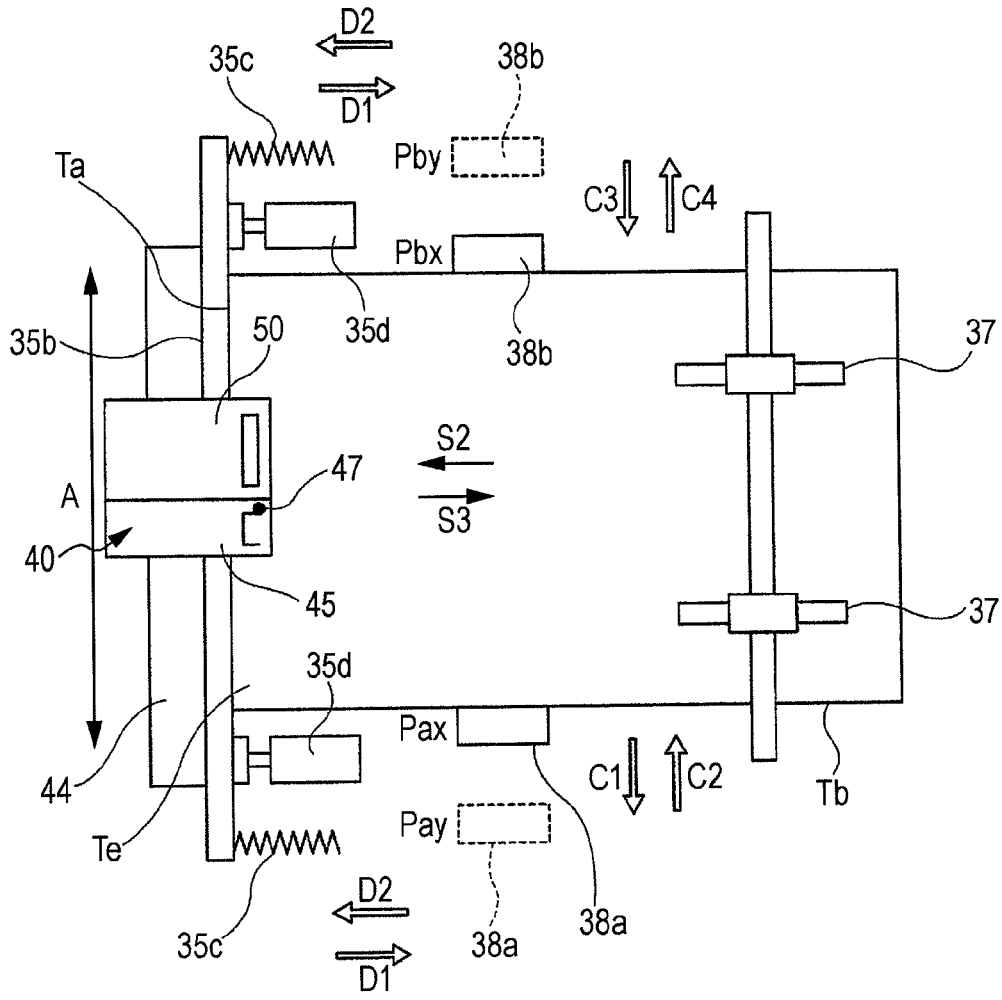
FIG. 3 is a schematic configuration diagram showing the periphery of the compiling stack portion when viewed in a direction indicated by arrow III in FIG. 2.
Figure 4A:
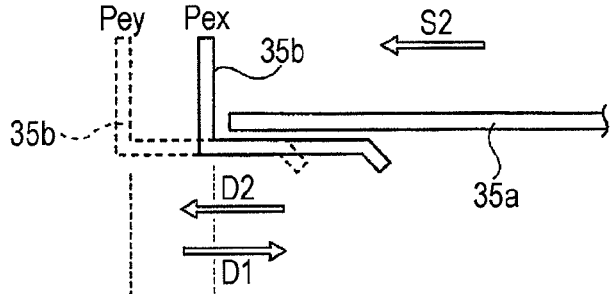
FIGS. 4A to 4C are explanatory views each explaining a relationship between an end guide and a sheet.
Figure 4B:
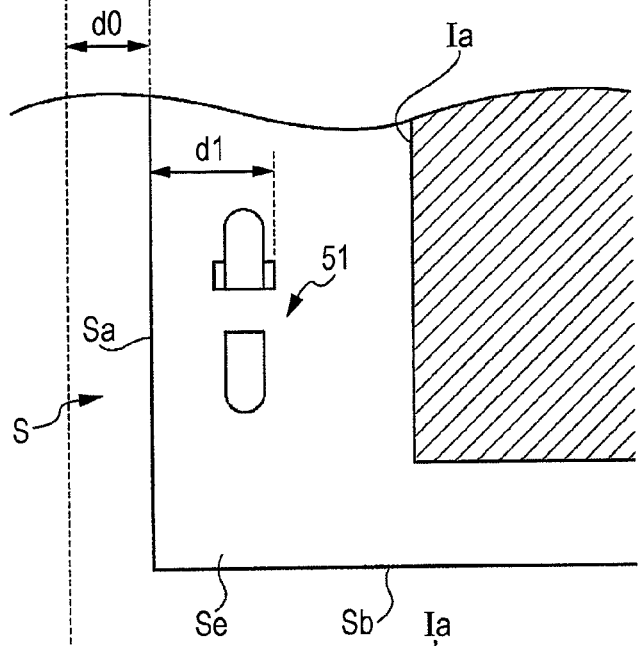
Figure 4C:
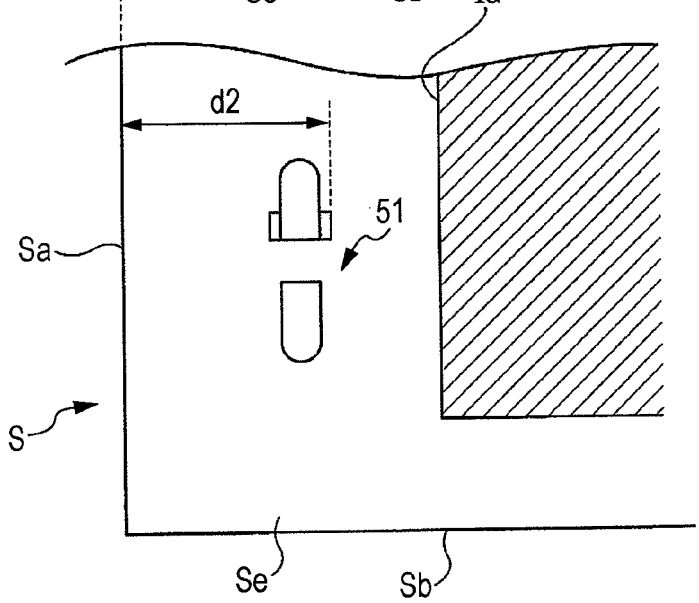

Next, the compiling stack portion 35 and the binding device 40 provided around the compiling stack portion 35 will be described with reference to FIGS. 2 to 4C. FIG. 2 is a schematic configuration diagram showing the periphery of the compiling stack portion 35. FIG. 3 is a schematic configuration diagram showing the periphery of the compiling stack portion 35 when viewed in a direction indicated by arrow III in FIG. 2. FIGS. 4A to 4C are explanatory views each explaining a relationship between the end guide 35*b* and the sheet S. FIG. 4A is an explanatory view explaining an operation of the end guide 35*b*. FIG. 4B is a schematic view showing a position of a bound part when the end guide 35*b* is close to a leading end part in a travel direction of a sheet S that falls along a bottom portion 35*a*. FIG. 4C is a schematic view showing a position of a bound part when the end guide 35*b* is separated from the leading end part in the travel direction of the sheet S that falls along the bottom portion 35*a*.

It is to be noted that FIG. 2 does not illustrate part of members such as an end-guide spring 35*c* for simplification of illustration. Also, the lower side in FIG. 3 indicates the user side of the image forming system 1, and corresponds to the near side (the side facing the viewer) of the drawings in FIGS. 1 and 2.

The compiling stack portion 35, which is an example of a stack unit, includes the bottom portion 35*a* having an upper surface on which the sheets S are stacked.

The bottom portion 35*a* is inclined such that the sheets S fall along the upper surface. Also, the compiling stack portion 35 includes the end guide 35*b* arranged to align leading ends in the travel direction of the sheets S falling along the bottom portion 35*a*.

Although it is described later in detail, regarding the movement of the sheet S in the periphery of the compiling stack portion 35, the sheet S is supplied toward the compiling stack portion 35 first (see a first travel direction S1 in FIG. 2), and the travel direction is reversed next, so that the sheet S falls along the bottom portion 35*a* of the compiling stack portion 35 (see a second travel direction S2 in FIG. 2). Then, ends of respective sheets S are aligned, and a bundle of the sheets S is formed. The travel direction of the bundle of sheets S is reversed, so that the bundle of sheets S is moved upward along the bottom portion 35*a* of the compiling stack portion 35 (see a third travel direction S3 in FIG. 2).

As shown in FIG. 3, in this exemplary embodiment, ends of the bottom portion 35*a* of the compiling stack portion 35 are defined as follows. An end at the leading side in the second travel direction S2 indicative of the direction in which the sheet S falls along the upper surface of the bottom portion 35*a* of the compiling stack portion 35 is called leading end part Ta. The leading end part Ta contacts the end guide 35*b*. Also, an end extending in the second travel direction S2 and located at the user side (lower side in FIG. 3) of the image forming system 1 is called lateral end part Tb. Further, a part arranged between the leading end part Ta and the lateral end part Tb is called corner part Te.

As shown in FIGS. 4A to 4C, in this exemplary embodiment, parts of a sheet S arranged on the bottom portion 35*a* of the compiling stack portion 35 are defined as follows. First, an end of the sheet S that extends along the leading end part Ta and contacts the end guide 35*b* is called first end part Sa. Also, an end that intersects with the first end part Sa and extends along the lateral end part Tb is called second end part Sb. Further, part of the sheet S arranged between the first end part Sa and the second end part Sb is called corner part Se.

As shown in FIGS. 4A to 4C, an end near the first end part Sa, of an image formed on the sheet S according to this exemplary embodiment is called image end Ia.

As shown in FIG. 4A, the end guide 35*b*, which is an example of an alignment member, is provided such that the end guide 35*b* may be advanced to and retracted from the bottom portion 35*a* of the compiling stack portion 35 (see arrows D1 and D2). Specifically, the end guide 35*b* is configured as follows.

The end guide 35*b* is longer than the bottom portion 35*a* of the compiling stack portion 35 in the vertical direction in FIG. 3. A pair of end-guide springs 35*c* and a pair of solenoids 35*d*, which are an example of a distance reducing unit, are connected to both ends of the end guide 35*b*. The end-guide springs 35*c* and the solenoids 35*d* are arranged at the same side (right side in FIG. 3) of the end guide 35*b*. The end-guide springs 35*c* are compressed and arranged to press the end guide 35*b* (see arrow D2). The solenoids 35*d* have extendable shafts. Tip ends of the shafts are connected to the end guide 35*b*.

As shown in FIG. 4A, the end guide 35*b* is movable between a position Pex close to the leading end part in the travel direction of the sheet S that falls along the bottom portion 35*a* and a position Pey separated from the leading end part in the travel direction of the sheet S that falls along the bottom portion 35*a*. The distance between the positions Pex and Pey is d0.

When the solenoids 35*d* are not actuated, the end guide 35*b* is pressed by the compressed end-guide springs 35*c* and hence is located at the position Pey separated from the leading end part in the travel direction of the sheet S that falls along the bottom portion 35*a*. In contrast, when the solenoids 35*d* are actuated, the end guide 35*b* is attracted by the solenoids 35*d* and hence is located at the position Pex close to the leading end part in the travel direction of the sheet S that falls along the bottom portion 35*a*.

Now, a phenomenon that the position of a bound part of sheets is shifted because the end guide 35*b* is moved will be described.

Described first is a state in which the end guide 35*b* is arranged at the position Pex. The end guide 35*b* is arranged at the position Pex, then the sheet S is supplied to the bottom portion 35*a* of the compiling stack portion 35, and the first end part Sa of the sheet S is arranged to contact the end guide 35*b*. If the binding processing is performed in this state, the distance from the first end part Sa to the part to be bound becomes small. In contrast, if the end guide 35*b* is arranged at the position Pey, the sheet S is arranged on the bottom portion 35*a* of the compiling stack portion 35, and the binding processing is performed, the distance from the first end part Sa to the part to be bound becomes large. More detailed description will be given below.

If the end guide 35*b* is arranged at the position Pex and the staple-less binding mechanism 50 performs the binding processing, the distance from an end of the bound part far from the first end part Sa to the first end part Sa is a distance d1 (see FIG. 4B). In contrast, if the end guide 35*b* is arranged at the position Pey and the binding processing is performed, the distance from the end of the bound part far from the first end part Sa to the first end part Sa is a distance d2 (see FIG. 4C). The distance d2 is larger than the distance d1. For example, the distance d2 is lager than the distance d1 by about 3 to 5 mm.

A case where the staple-less binding mechanism 50 performs the binding processing (i.e., a staple-less bound part 51 is arranged, described later in detail) has been described with reference to FIGS. 4A to 4C; however, a stapler 45 may perform binding processing (i.e., a staple 41 is arranged, described later in detail). That is, the end guide 35*b* is configured to change the distance from the first end part Sa of the sheet S to the bound part when the binding processing is performed by any of the staple-less binding mechanism 50 and the stapler 45.

Description goes back to respective members of the image forming system 1. The paddle 37 is provided above the compiling stack portion 35 and downstream of the exit roller 34 in the first travel direction S1 of the sheet S. The paddle 37 is provided such that the distance between the paddle 37 and the bottom portion 35*a* of the compiling stack portion 35 is changed by driving of a motor or the like (not shown). Specifically, the paddle 37 is provided movably in directions indicated by arrows U1 and U2 in FIG. 2. When the paddle 37 moves in the direction indicated by arrow U1, the paddle 37 is arranged close to the bottom portion 35*a* of the compiling stack portion 35 (position Pb illustrated by solid lines). When the paddle 37 moves in the direction indicated by arrow U2, the paddle 37 is separated from the bottom portion 35*a* of the compiling stack portion 35 (position Pa illustrated by broken lines). The paddle 37 pushes the sheet S transported in the first travel direction S1 in FIG. 2, into the second travel direction S2 on the compiling stack portion 35 by rotation of the paddle 37 in a direction indicated by arrow R in FIG. 2.

The tamper 38 (see FIG. 1) includes a first tamper 38*a* and a second tamper 38*b* that face each other with the compiling stack portion 35 arranged therebetween. Specifically, the first tamper 38*a* and the second tamper 38*b* are arranged to face each other in a direction (vertical direction in FIG. 3) intersecting with the second travel direction S2. The distance between first tamper 38*a* and the second tamper 38*b* is changed by driving of a motor or the like (not shown).

The tamper 38 aligns the ends in the travel direction of the sheets S that fall along the bottom portion 35*a*. Specifically, the first tamper 38*a* moves (arrows C1 and C2) between a position close to the compiling stack portion 35 (position Pax illustrated by solid lines) and a position separated from the compiling stack portion 35 (position Pay illustrated by broken lines). The second tamper 38*b* moves (arrows C3 and C4) between a position close to the compiling stack portion 35 (position Pbx illustrated by solid lines) and a position separated from the compiling stack portion 35 (position Pby illustrated by broken lines).

The positions Pax, Pay, Pbx, and Pby of the first tamper 38*a* and the second tamper 38*b* according to this exemplary embodiment are selectable in accordance with the size and orientation of the sheets S supplied to the compiling stack portion 35.

The eject roller 39 includes a first eject roller 39*a* and a second eject roller 39*b*. The first eject roller 39*a* and the second eject roller 39*b* are arranged above and below the bottom portion 35*a* of the compiling stack portion 35 and face each other with the bottom portion 35*a* arranged therebetween.

The first eject roller 39*a* is provided at a side near a surface of the bottom portion 35*a* of the compiling stack portion 35, the surface on which the sheets S are stacked. Further, the first eject roller 39*a* may be advanced to and retracted from the second eject roller 39*b* by driving of a motor or the like (not shown). That is, the first eject roller 39*a* is configured such that the distance between the first eject roller 39*a* and the sheets S stacked on the bottom portion 35*a* of the compiling stack portion 35 is changeable. In contrast, the second eject roller 39*b* is arranged at a side near a back surface of the bottom portion 35*a* of the compiling stack portion 35, the back surface on which the sheets S are not stacked. The position of the second eject roller 39*b* is fixed and is available for only rotational movement.

Specifically, when the first eject roller 39*a* moves in a direction indicated by arrow Q1, the first eject roller 39*a* is arranged close to the bottom portion 35*a* of the compiling stack portion 35 (position P2 illustrated by broken lines). In contrast, when the first eject roller 39*a* moves in a direction indicated by arrow Q2, the first eject roller 39*a* is separated from the bottom portion 35*a* of the compiling stack portion 35 (position P1 illustrated by solid lines).

The first eject roller 39*a* receives driving of a motor or the like (not shown) while the first eject roller 39*a* contacts the sheet S, and is rotated in a T1 direction. Accordingly, the bundle of sheets S is moved upward (in the third travel direction S3) and transported.

The positions P1 and P2 of the first eject roller 39*a* may be changed in accordance with the number and thickness of sheets S that are supplied to the compiling stack portion 35.

Binding Device 40

Figure 5:
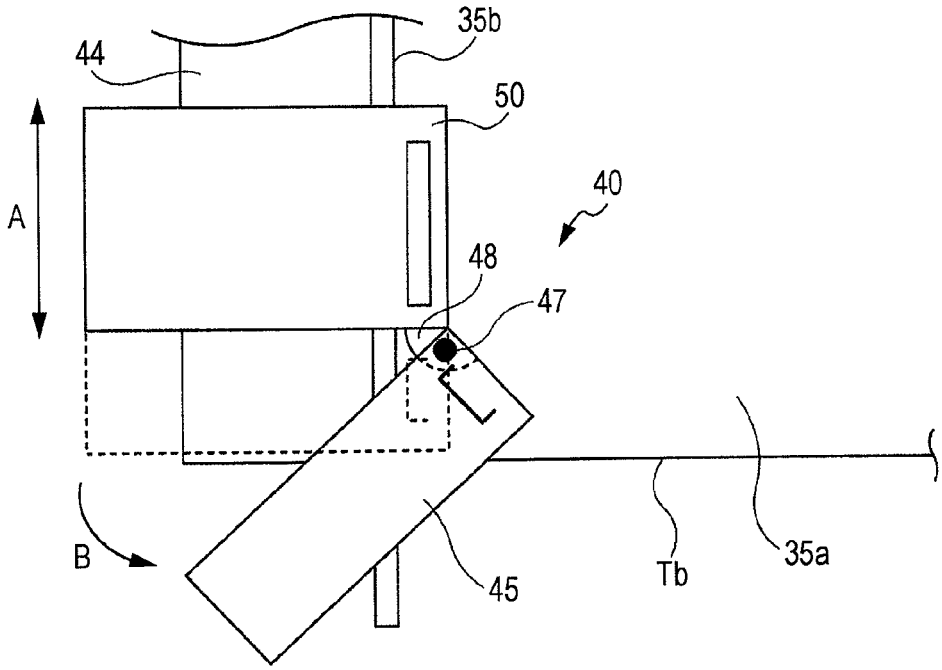
FIG. 5 is an explanatory view explaining a structure of a binding device.
Figure 6A:
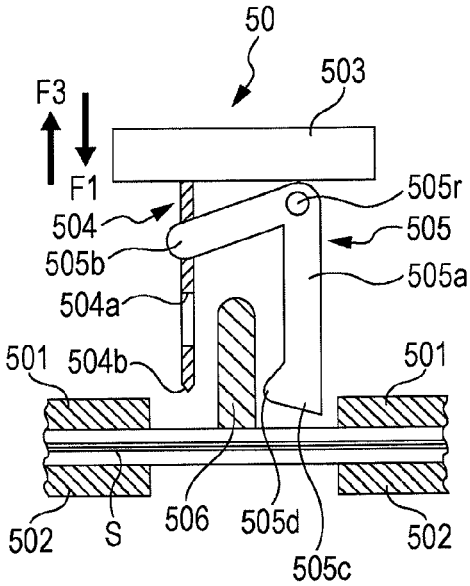
FIGS. 6A to 6D are explanatory views explaining a configuration of staple-less binding mechanism and a part processed by staple-less binding processing.
Figure 6B:
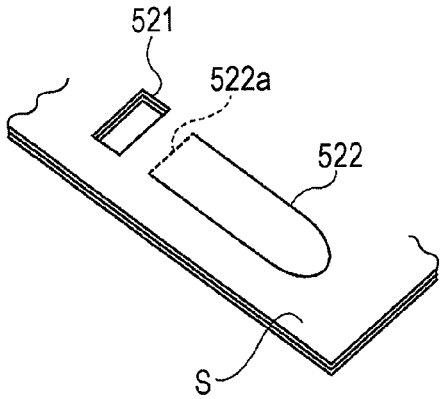
Figure 6C:
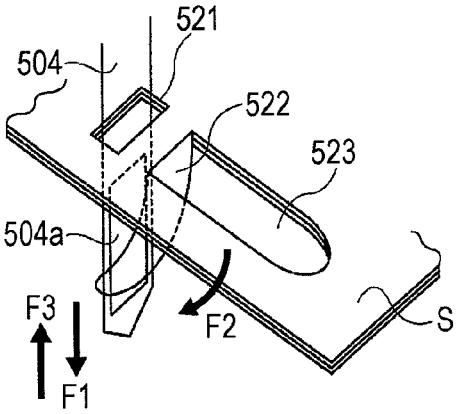
Figure 6D:
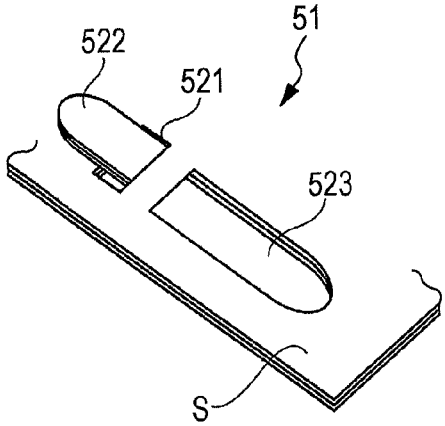

Next, the binding device 40 will be described with reference to FIGS. 3 and 6A to 6D. FIG. 5 is an explanatory view explaining a structure of the binding device 40. FIGS. 6A to 6D are explanatory views explaining a configuration of a staple-less binding mechanism 50 and a part processed by the staple-less binding processing. FIG. 6A is an illustration explaining a configuration of the staple-less binding mechanism 50. FIG. 6B is an illustration explaining a slit 521 and a tongue 522 that are formed in the sheets S. FIG. 6C is an illustration explaining an operation of inserting the tongue 522 into the slit 521. FIG. 6D is an illustration explaining a part bound by the staple-less binding mechanism 50.

The binding device 40 includes the stapler 45, which is an example of a first binding unit; and the staple-less binding mechanism 50, which is an example of a second binding unit. The stapler 45 binds the end parts of the bundle of sheets S housed in the compiling stack portion 35 by pushing a staple 41 (described later) one by one into the sheets S. The staple-less binding mechanism 50 binds the end parts of the bundle of sheets S housed in the compiling stack portion 35 by processing part of the sheets S without using the staple 41. The stapler 45 and the staple-less binding mechanism 50 are coupled to each other through a joint 48, and are continuously provided in a direction along the leading end part Ta.

The stapler 45 is arranged at the user side (lower side in FIG. 3) of the image forming system 1 with respect to the staple-less binding mechanism 50. Since the stapler 45 is arranged at the user side (lower side in FIG. 3), maintenance work for the stapler 45, such as supplement of staples 41 etc., may be easily carried out.

The stapler 45 uses the staples 41. In contrast, the staple-less binding mechanism 50 does not use a member that requires supplement of, for example, the staples 41. Therefore, the frequency of the maintenance work for the stapler 45 is higher than the frequency of the maintenance work for the staple-less binding mechanism 50. Hence, it is desirable to easily carry out the work for the stapler 45.

The binding device 40 is arranged on a rail 44. The binding device 40 is movable in a direction (see arrow A) along the leading end part Ta by a motor (not shown). Accordingly, the stapler 45 and the staple-less binding mechanism 50 may perform the binding processing at any position at the leading end part Ta of the bottom portion 35*a*.

Stapler 45

The stapler 45 performs the binding processing at the corner part Te of the bottom portion 35*a* in addition to the leading end part Ta of the bottom portion 35*a*. For this point, the stapler 45 differs from the staple-less binding mechanism 50 that performs the binding processing only at the leading end part Ta of the bottom portion 35*a*.

Specifically, the stapler 45 is configured as follows.

The stapler 45 includes a rotation shaft 47 at a side close to the staple-less binding mechanism 50 and at the leading end part Ta. The rotation shaft 47 is coupled to a motor (not shown).

By driving of the motor (not shown), the stapler 45 is rotatable around the rotation shaft 47 (see arrow B). That is, the stapler 45 swings. The stapler 45 is rotatable independently from the staple-less binding mechanism 50 while the stapler 45 is continuously coupled to the staple-less binding mechanism 50 through the joint 48. The rotation of the stapler 45 does not cause the staple-less binding mechanism 50 to move.

The stapler 45 binds the end parts of the bundle of sheets S housed in the compiling stack portion 35 by pushing a staple 41 (described later) one by one into the sheets S. In particular, when a stapler motor (not shown) is driven, the stapler 45 pushes a single staple 41 (described later) into the bundle of sheets S. The staple 41 is pushed into the bundle of sheets S and ends of the staple 41 are bent at the opposite side of the bundle of sheets S. Thus, the bundle of sheets S is bound. The pushed staple 41 is arranged at the corner parts Se of the sheets S, in an oblique state with respect to the first end parts Sa of the sheets S.

Staple-less Binding Mechanism 50

The staple-less binding mechanism 50 binds the end parts of the bundle of sheets S housed in the compiling stack portion 35 without using the staple 41. Specifically, the staple-less binding mechanism 50 is configured as follows.

The staple-less binding mechanism 50 includes a base 501 and a body 503 arranged to face each other. As shown in FIG. 6A, the body 503 is moved toward the base 501 (in a F1 direction in the drawing) while the bundle of sheets S is pinched by the base 501, so that the bundle of sheets S is bound.

The base 501 is provided with a bottom member 502 that is arranged substantially in parallel to the base 501 to cause the sheets S to be pinched between the base 501 and the bottom member 502. The base 501 also includes a protrusion 506 that extends toward the body 503 and is integrally formed with the base 501.

The body 503 includes a blade 504 that makes a cut in the bundle of sheets S, and a punching member 505 that forms the tongue 522 (described later) in the bundle of sheets S, bends the tongue 522, and inserts the tongue 522 into the cut formed by the blade 504.

The blade 504 is made of a substantially rectangular plate member extending toward the bundle of sheets S pinched between the base 501 and the bottom member 502. Specifically, the blade 504 has an eyelet hole 504*a* in the substantially rectangular surface, and a tip end portion 504*b* with a width that is decreased toward the sheets S.

The punching member 505 is a member including a substantially L-shaped bent part. One end part of the punching member 505 is a first portion 505*a* and the other end part is a second portion 505*b*.

The punching member 505 includes a first-portion rotation shaft 505*r* provided at the substantially L-shaped bent part. The punching member 505 is rotatable around the first-portion rotation shaft 505*r*. More specifically, the first portion 505*a* may be inclined toward the blade 504. It is to be noted that a gap is provided between the second portion 505*b* and the body 503 so that the punching member 505 is rotatable.

The first portion 505*a* extends toward the base 501. Also, the first portion 505*a* has a cutting edge 505*c* at a side opposite to a side provided with the first-portion rotation shaft 505*r*, i.e., at a side facing the base 501. The cutting edge 505*c* has a cutting edge that punches the shape of the tongue 522. The cutting edge 505*c* does not have a cutting edge at a side facing the blade 504, and is configured such that the tongue 522 continuously arranged with the sheets S at one end 522*a* (described later). Further, the first portion 505*a* includes a protrusion 505*d* at a lateral side of the first portion 505*a*, in particular, at a side facing the blade 504. The protrusion 505*d* extends toward the blade 504.

The operation for performing the binding processing by the staple-less binding mechanism 50 is as follows.

A staple-less binding motor (not shown) is driven, the body 503 moves toward the base 501, and the tip end portion 504*b* of the blade 504 and the cutting edge 505*c* of the punching member 505 penetrate through the bundle of sheets S. Then, as shown in FIG. 6B, formed in the bundle of sheets S as the result of the penetration are the slit 521, which is an example of a cut, and the tongue 522, which is an example of a partially punched sheet piece, made by punching the bundle of sheets S while the one end 522*a* is not cut.

When the body 503 is further pushed down, the second portion 505*b* of the punching member 505 contacts the protrusion 506 integrally formed with the base 501, and the punching member 505 rotates clockwise in FIG. 6A around the first-portion rotation shaft 505*r*. Accordingly, the first portion 505*a* is inclined toward the blade 504, and the protrusion 505*d* of the punching member 505 becomes close to the blade 504. The protrusion 505*d* of the punching member 505 bends the tongue 522 as shown in FIG. 6C, and pushes the tongue 522 in a F2 direction in the drawing toward the eyelet hole 504*a* of the blade 504. It is to be noted that FIG. 6C does not illustrates the punching member 505.

In this state, the body 503 is separated from the base 501. In particular, the body 503 is moved upward in a F3 direction in the drawing, and the body 503 is moved upward while the tongue 522 is hooked to the eyelet hole 504*a* of the blade 504. As shown in FIG. 6D, the tongue 522 is inserted into the slit 521. Thus, the bundle of sheets S is bound. The bundle of sheets S has a binding hole 523 from which the tongue 522 is punched.

Comparison Between Bound Parts

Figure 7A:
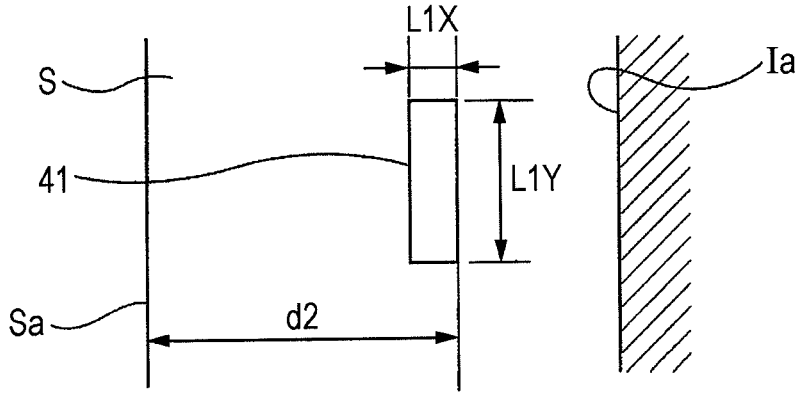
FIGS. 7A and 7B are schematic configuration diagrams showing parts bound by a stapler and the staple-less binding mechanism.
Figure 7B:
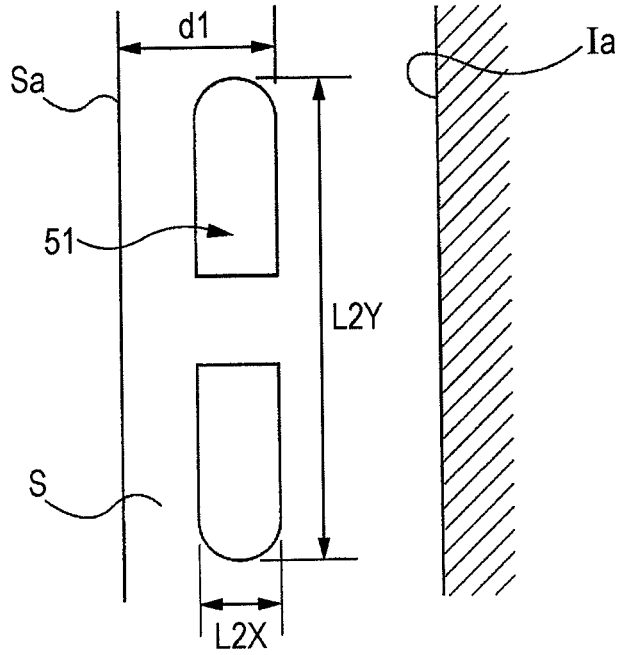

Next, the parts bound by the stapler 45 and the staple-less binding mechanism 50 will be described with reference to FIGS. 7A and 7B. FIGS. 7A and 7B are schematic configuration diagrams showing the parts bound by the stapler 45 and the staple-less binding mechanism 50.

The staple 41 is arranged at the part bound by the stapler 45. In contrast, a staple-less bound part 51 is formed at the part bound by the staple-less binding mechanism 50.

The staple 41 and the staple-less bound part 51 are arranged so as not to overlap an image to be formed on the sheets S. This arrangement is to prevent the formed image from being hard to be unrecognized.

The staple-less bound part 51 has a larger length in the width direction (length L2X) than the length in the width direction (length L1X) of the staple 41. The staple-less bound part 51 has a larger length in the longitudinal direction (length L2Y) than the length in the longitudinal direction (length L1Y) of the staple 41. Accordingly, the area of the needle-less bound part 51 is larger than the area of the staple 41.

This exemplary embodiment employs the configuration in which the staple 41 provides the binding processing at the corner part Te of the bottom portion 35*a* because the length in the longitudinal direction of the staple 41 is smaller than that of the staple-less bound part 51. If the staple-less bound part 51 with the larger length in the longitudinal direction is obliquely arranged at the corner part Te of the bottom portion 35*a*, the staple-less bound part 51 is arranged close to the center part of the sheets S, and hence may occasionally overlap the image formed on the sheets S.

Further, the staple-less bound part 51 has the binding hole 523 at the position from which the tongue 522 is punched. As the result, part between the binding hole 523 and the first end parts Sa of the sheets S are likely ripped. In particular, if another member is inserted through the binding hole 523 formed in the sheets S for filing, the sheets S are more likely ripped. When the staple-less bound part 51 is arranged, the staple-less bound part 51 has to be arranged at a position separated from the first end parts Sa of the sheets S by a predetermined distance.

In other words, the staple-less bound part 51 requires a binding margin larger than that of the staple 41. The binding margin is an edge part of a sheet S without an image. For example, the binding margin located close to the first end part Sa of the sheet S is part extending from the image end Ia close to the first end part Sa of the sheet S to the first end part Sa.

To prevent the sheets S from being ripped, the required distance from the staple-less bound part 51 to the first end parts Sa of the sheets S varies in accordance with the strength of the material of the sheets S to be bound and the number of sheets S to be bound.

Operation of Image Forming System 1

Next, the operation of the image forming system 1 will be described with reference to FIGS. 1 to 4C. Described here is a case where the stapler 45 of the binding device 40 performs the binding processing at the leading end part Ta.

First, the respective members are arranged as follows before a toner image is formed on a first sheet S by the image forming section 5 of the image forming apparatus 2. The first eject roller 39*a* is arranged at the position P1, the paddle 37 is arranged at the position Pa, the first tamper 38*a* is arranged at the position Pay, and the second tamper 38*b* is arranged at the position Pbx. Also, the end guide 35*b* is arranged at the position Pey separated from the bottom portion 35*a*.

Then, the toner image is formed on the first sheet S by the image forming section 5 of the image forming apparatus 2. As shown in FIG. 1, the first sheet S with the toner image formed is reversed if necessary by the sheet reverse device 7. Then, the first sheet S is supplied to the sheet processing apparatus 3 through the output roller 9 one by one.

The transport device 10 of the sheet processing apparatus 3 to which the first sheet S is supplied receives the first sheet S by the entrance roller 11, and performs punching for the first sheet S if necessary by the puncher 12. Then, the first sheet S is transported toward the downstream-side post-processing device 30 through the first transport roller 13 and the second transport roller 14.

The post-processing device 30 receives the first sheet S from the receive roller 31. The first sheet S passed through the receive roller 31 is transported in the first travel direction S1 by the exit roller 34. At this time, the first sheet S is transported so as to pass through a position between the compiling stack portion 35 and the first eject roller 39*a* and through a position between the compiling stack portion 35 and the paddle 37.

After the leading end of the first sheet S in the first travel direction S1 passes through the position between the compiling stack portion 35 and the paddle 37, the paddle 37 moves downward from the position Pa (moves in the direction indicated by arrow U1 in FIG. 2) and is arranged at the position Pb. Hence, the paddle 37 contacts the first sheet S. The first sheet S is pushed into the second travel direction S2 in FIG. 2 by the rotation of the paddle 37 in the direction indicated by arrow R in FIG. 2. The end of the first sheet S close to the end guide 35*b* contacts the end guide 35*b*. Then, the paddle 37 moves upward (moves in the direction indicated by arrow U2 in FIG. 2), is separated from the first sheet S1, and is located at the position Pa again.

Further, the first sheet S is received by the compiling stack portion 35, and the end near the end guide 35*b* reaches the end guide 35*b*. Then, the first tamper 38*a* moves close to the compiling stack portion 35 from the position Pay (moves in the direction indicated by arrow C2 in FIG. 3), and is arranged at the position Pax. At this time, the second tamper 38*b* is still arranged at the position Pbx. Accordingly, the first tamper 38*a* pushes the first sheet S, and the first sheet S contacts the second tamper 38*b*. Then, the first tamper 38*a* moves away from the compiling stack portion 35 (moves in the direction indicated by arrow C1 in FIG. 3). Accordingly, the first tamper 38*a* is separated from the first sheet S and is arranged at the position Pay again.

When second and later sheets S having toner images formed by the image forming section 5 and following the first sheet S are supplied successively to the post-processing device 30, the paddle 37 and the tamper 38 align the ends of the sheets S in a manner similar to the above-described operation. The second sheet S is supplied after the first sheet S is aligned, and the second sheet S is aligned with the first sheet S. The similar operation is performed also when third and later sheets are supplied. Accordingly, sheets S are housed in the compiling stack portion 35 by a predetermined number, ends of the sheets S are aligned, and a bundle of the sheets S is formed.

Then, the first eject roller 39*a* moves downward form the position P1 (moves in the direction indicated by arrow Q1 in FIG. 2), and is arranged at the position P2. Accordingly, the bundle of aligned sheets S is pinched between and fixed by the first eject roller 39*a* and the second eject roller 39*b*.

The stapler 45 binds end parts of the sheets S stacked on the compiling stack portion 35. Specifically, the motor (not shown) moves the binding device 40 along the rail 44 (see arrow A) to arrange the binding device 40 such that the stapler 45 faces a part to be bound. Then, the stapler motor (not shown) is driven to push the staple 41 into the sheets S. Thus, the binding processing is performed. At this time, the distance from an end of the staple 41 at a side far from the first end part Sa to the first end part Sa is a distance d2.

The bundle of sheets S bound by the stapler 45 is output from the compiling stack portion 35 by rotation of the first eject roller 39*a* (arrow T1 in FIG. 2). The bundle of sheets S passes through the opening 69, and output to the stack portion 70.

Binding Processing Operation for Corner Part Te

Next, the operation when the stapler 45 performs the binding processing at the corner part Te of the bottom portion 35*a* will be described. Here, part of the operation different from the operation of the image forming system 1 will be described.

After the bundle of aligned sheets S is pinched between and fixed by the first eject roller 39*a* and the second eject roller 39*b*, the binding device 40 moves along the rail 44 by driving of the motor (not shown) and becomes close to the corner part Te of the bottom portion 35*a*.

At the position of the binding device 40 close to the corner part Te, the stapler 45 is rotated (see arrow B) by rotation of the motor (not shown). Specifically, the stapler 45 moves from the position at which the stapler 45 is arranged continuously from the staple-less binding mechanism 50 (see stapler 45 illustrated by broken lines in FIG. 5) to the position at which the stapler 45 faces the corner part Te of the bottom portion 35*a* (see stapler 45 illustrated by solid lines in FIG. 5). In other words, the stapler 45 and the staple-less binding mechanism 50 are integrally arranged because the stapler 45 and the staple-less binding mechanism 50 are coupled to each other through the joint 48. When the stapler 45 is rotated around the rotation shaft 47, the stapler 45 moves away from the staple-less binding mechanism 50 while being coupled to the staple-less binding mechanism 50 through the joint 48.

The angle of the stapler 45 is changed, and the stapler motor (not shown) is driven at the position at which the stapler 45 faces the corner part Te. Accordingly, the staple 41 is pushed into the sheets S.

The stapler 45 may be rotated (see arrow B) although the position of the staple-less binding mechanism 50 is not moved (for example, the staple-less binding mechanism 50 is not rotated). For example, when the stapler 45 faces the corner part Te, a protruding length of the binding device 40 in the outer peripheral direction of the compiling stack portion 35 becomes smaller in a case where only the stapler 45 is rotated as compared with the protruding length in a case where the stapler 45 and the staple-less binding mechanism 50 are rotated. Accordingly, in this exemplary embodiment, only the stapler 45 is rotated. Hence, the size of the sheet processing apparatus 3 may be reduced.

The rotation of the stapler 45 by driving of the motor is described as a changing unit that changes the angle of the stapler 45. However, it is not limited thereto.

For example, the stapler 45 may include a substantially hook-like member, and the rail 44 may include a protrusion at a position near the corner part Te, so that the protrusion engages with the substantially hook-like member. When the binding device 40 becomes close to the corner part Te, the substantially hook-like member engages with the protrusion. The stapler 45 receives the engagement force, and the stapler 45 is rotated around the rotation shaft 47.

Alternatively, part of the rail 44, on which the binding device 40 is mounted, may be curved. In particular, part of the straight rail 44 close to the corner part Te is curved toward the corner part Te. When the binding device 40 becomes close to the corner part Te, the stapler 45 receives a force from the curved part of the rail 44, so that the stapler 45 is pressed toward the corner part Te. The stapler 45 receives the force, and the stapler 45 is rotated around the rotation shaft 47.

Binding Processing Operation of Staple-less Binding Mechanism 50

Next, the operation when the staple-less binding mechanism 50 performs the binding processing at the leading end part Ta will be described.

As described above, the staple-less bound part 51 has a larger area than the area of the staple 41. Hence, if the transport position of sheets S in the image forming system 1 varies, the staple-less bound part 51 with a larger area may likely overlap an image. Thus, when the staple-less binding mechanism 50 performs the binding processing, the distance from the image to the bound part has to be sufficient to reliably avoid the overlap between the image and the bound part.

To provide the sufficient distance from the image to the bound part to avoid the overlap between the image and the bound part, according to an exemplary embodiment, the end of the image formed on the sheet S is shifted. In other words, this exemplary embodiment is that the area of the binding margin is increased. According to another exemplary embodiment, the position of the bound part on the sheet S is shifted away from the image.

By using any of the two exemplary embodiments, the distance may be sufficiently provided from the image to the bound part to reliably avoid the overlap between the image and the bound part. Also, the two exemplary embodiments may be used together. The respective exemplary embodiments will be described below.

Shift of Image

First, the exemplary embodiment in which the end of the image to be formed on the sheet S is shifted will be described with reference to FIGS. 1, and 8A and 8B. Described here is only part of the operation different from the operation of the image forming system 1 when the stapler 45 performs the binding processing at the leading end part Ta.

Figure 8A:
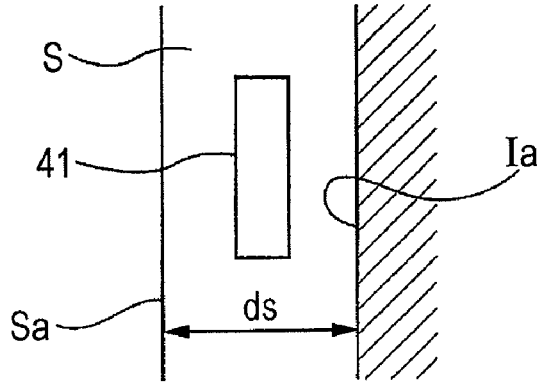
FIGS. 8A and 8B are explanatory views each explaining a positional relationship between a first end part Sa of a sheet S and an image formed on the sheet S.
Figure 8B:
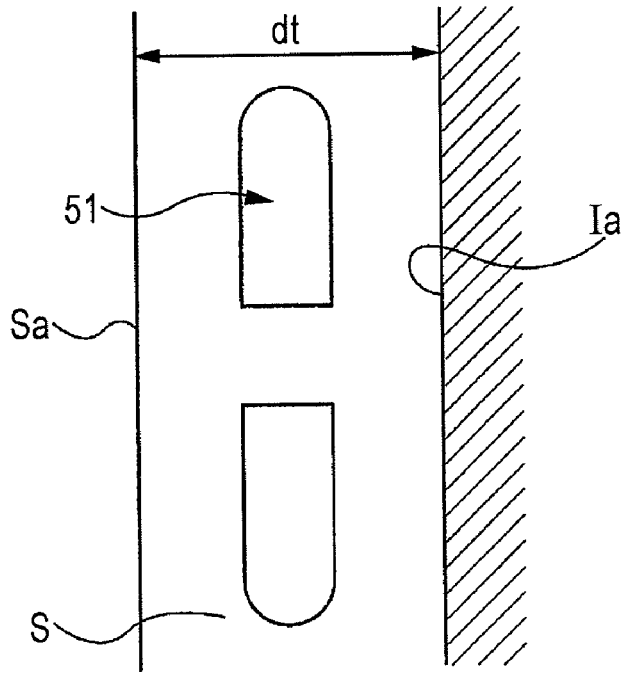

FIGS. 8A and 8B are explanatory views each explaining a positional relationships between the first end part Sa of the sheet S and the image formed on the sheet S. FIG. 8A illustrates the positional relationship between the sheet S and the image when the stapler 45 performs the binding processing, and FIG. 8B illustrates the positional relationship between the sheet S and the image when the staple-less binding mechanism 50 performs the binding processing.

When the staple-less binding mechanism 50 performs the binding processing, the controller 80, which is an example of a distance changing unit, sends a control signal to the image forming section 5 so that the position of the image to be formed by the image forming section 5 is changed before the image forming section 5 forms the image on the sheet S. When the image forming section 5 receives the signal, the image forming section 5 changes the distance from the end of the sheet S to the image to be formed, from a distance when the stapler 45 performs the binding processing.

Specifically, the operation is as shown in FIGS. 8A and 8B. The image forming section 5 is controlled such that the distance from the image end Ia, which is the end of the image near the first end part Sa, to the first end part Sa when the stapler 45 performs the binding processing differs from the distance when the staple-less binding mechanism 50 performs the binding processing.

When the stapler 45 performs the binding processing, the distance from the image end Ia to the first end part Sa is a distance ds. When the staple-less binding mechanism 50 performs the binding processing, the distance from the image end Ia to the first end part Sa is a distance dt. The distance dt is larger than the distance ds. For example, the distance dt is lager than the distance ds by about 3 to 5 mm.

Since the position of the image is changed, the larger binding margin is formed when the staple-less binding mechanism 50 performs the binding processing. Accordingly, the overlap between the image and the bound part may be reliably avoided.

In this exemplary embodiment, when the image forming section 5 forms the image on the sheet S, the size etc. of the image is not changed, but only the position of the image is changed. In other words, this exemplary embodiment is that the image to be formed on the sheet S is shifted on the sheet S.

However, it is not limited thereto, and another configuration may be made as long as the configuration provides a larger binding margin when the staple-less binding mechanism 50 performs the binding processing.

For example, the scale of the image to be formed may be changed between the case where the stapler 45 performs the binding processing and the case where the staple-less binding mechanism 50 performs the binding processing. Specifically, the entire image may be scaled down without the center of the image being shifted in the case where the staple-less binding mechanism 50 performs the binding processing, with reference to the image in the case where the stapler 45 performs the binding.

Further, the image may be processed. Specifically, the aspect ratio of the image may be changed in the case where the staple-less binding mechanism 50 performs the binding processing, with reference to the image in the case where the stapler 45 performs the binding processing. That is, the image may be scaled down only in a direction intersecting with the first end part Sa of the sheet S without the center of the image in that direction being shifted.

The respective exemplary embodiments may be combined. That is, the image to be formed on the sheet S may be scaled down and also the image may be shifted. Alternatively, the aspect ratio of the image to be formed on the sheet S may be changed and also the image may be shifted.

Shift of Bound Part

Next, the exemplary embodiment in which the position of the bound part on the sheet S is shifted will be described with reference to FIGS. 1, 4A to 4C, and 9A and 9B.

Figure 9A:
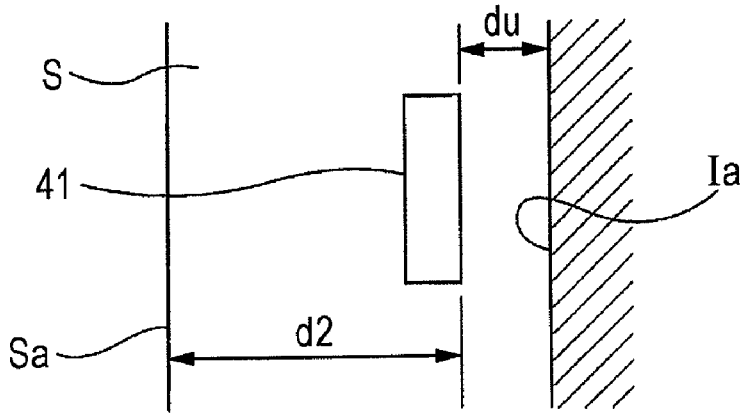
FIGS. 9A and 9B are explanatory views each explaining a positional relationship between a bound part of a sheet and an image formed on the sheet.
Figure 9B:
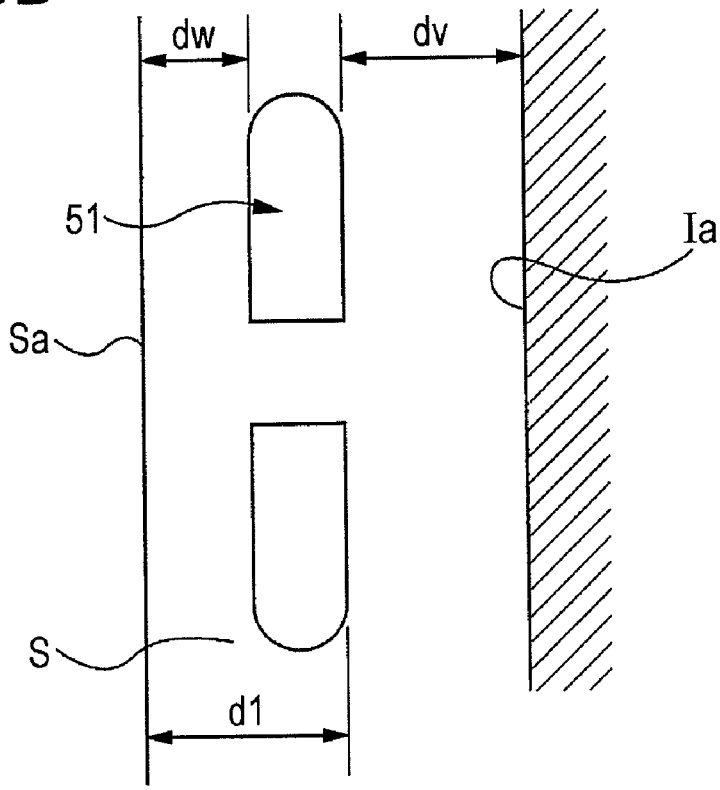

FIGS. 9A and 9B are explanatory views each explaining a positional relationship between the bound part and the image formed on the sheet S. FIG. 9A illustrates the positional relationship between the staple 41 and the image, and FIG. 9B illustrates the positional relationship between the staple-less bound part 51 and the image.

First, the case where the stapler 45 performs the binding processing is described as a subject of comparison. Before the image forming section 5 forms the image, the controller 80 sends a control signal to the solenoid 35*d* such that the end guide 35*b* is arranged at a designated position.

If the stapler 45 performs the binding processing, the solenoid 35*d* is not actuated, and the end guide 35*b* is arranged at the position Pey. When the sheets S are arranged on the bottom portion 35*a* of the compiling stack portion 35 and the binding processing is performed, the distance from the first end part Sa to the end of the bound part (staple 41) near the image is a distance d2. Also, the distance from the end of the bound part near the image to the image end Ia is a distance du.

If the staple-less binding mechanism 50 performs the binding processing, the solenoid 35*d* is actuated, and the end guide 35*b* is arranged at the position Pex. When the sheets S are arranged on the bottom portion 35*a* of the compiling stack portion 35 and the binding processing is performed, the distance from the first end part Sa to the end of the bound part (staple-less bound part 51) near the image is a distance d1. Also, the distance from the end of the bound part near the image to the image end Ia is a distance dv.

Here, the distance dv is equal to or larger than the distance du. For example, the distance dv is lager than the distance du by about 3 to 5 mm.

Since the position of the end guide 35*b* is changed, as the result, the distance dv becomes larger than the distance du. Accordingly, the overlap between the image and the bound part may be reliably avoided.

The distance d1 is smaller than the distance d2 as described above. In a related matter, if the position of the staple-less bound part 51 becomes close to the first end parts Sa of the sheets S, the sheets S may be likely ripped. That is, if the distance (see distance dw) from the end of the staple-less bound part 51 near the first end part Sa to the first end part Sa is small, the sheets S may be likely ripped. Hence, the distance dw has to be equal to a larger than a width required for preventing the sheets S from being ripped.

Other Exemplary Embodiments

Figure 10:
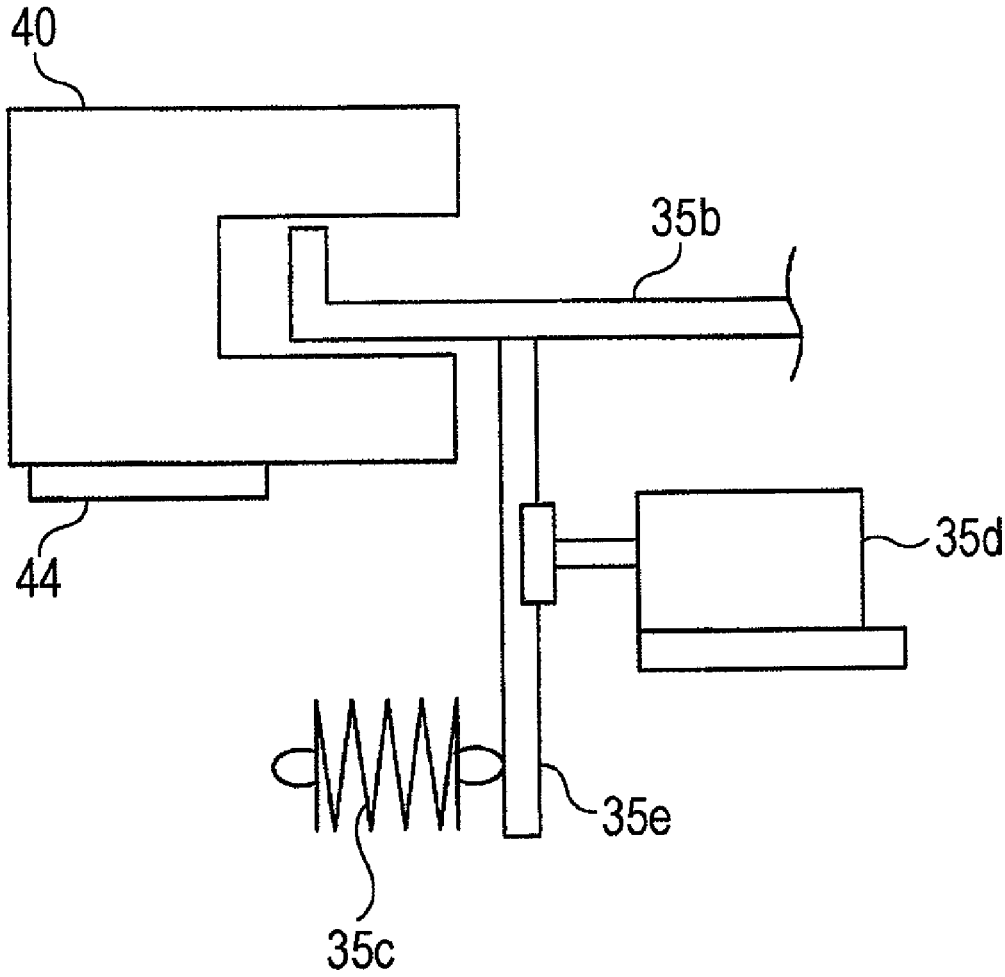
FIG. 10 is a side view showing the periphery of an end guide according to other exemplary embodiment.

Now, other exemplary embodiment for moving the end guide 35*b* will be described with reference to FIG. 10. FIG. 10 is a side view showing the periphery of an end guide 35*b* for other exemplary embodiment.

As shown in FIG. 10, an actuation plate 35*e* is provided below the end guide 35*b*. The actuation plate 35*e* extends in a direction intersecting with the bottom portion 35*a*. Also, an end-guide spring 35*c* is connected to one side of the actuation plate 35*e*, at a position at which the end-guide spring 35*c* does not interrupt the operation of the binding device 40. Another end of the end-guide spring 35*c* opposite to the end that is connected to the actuation plate 35*e* is fixed to, for example, a housing (not shown) of the post-processing device 30. Also, a solenoid 35*d* is provided at a side of the actuation plate 35*e* opposite to the side arranged with the end-guide spring 35*c*. The solenoid 35*d* is fixed to, for example, the housing (not shown) of the post-processing device 30. When the solenoid 35*d* is actuated, the end guide 35*b* is attracted and is arranged at a position Pex at which the end guide 35*b* is close to the leading end part in the travel direction of the sheet S that falls along the bottom portion 35*a*, and when the solenoid 35*d* is not actuated, the end guide 35*b* is arranged at a position Pey at which the end guide 35*b* is separated from the leading end part in the travel direction of the sheet S that falls along the bottom portion 35*a*.

In the above-described exemplary embodiment, the position of the binding device 40 is not moved in the direction intersecting with the first end part Sa of the sheet S (i.e., direction along the second end part Sb). However, it is not limited thereto. For example, the binding device 40 may be provided on a stage movable in the direction intersecting with the rail 44. Also, a solenoid 35*d* that moves the stage in the direction intersecting with the rail 44 may be connected. By driving the solenoid 35*d*, the binding device 40 may be moved in the direction intersecting with the first end part Sa of the sheet S. With this configuration, the distance from the first end part Sa of the sheet S to the bound part may be changed.

Further, in the above-described exemplary embodiment, the staple-less binding mechanism 50 performs the binding processing by the tongue 522 and the slit 521. However, it is not limited thereto.

Figure 11A:
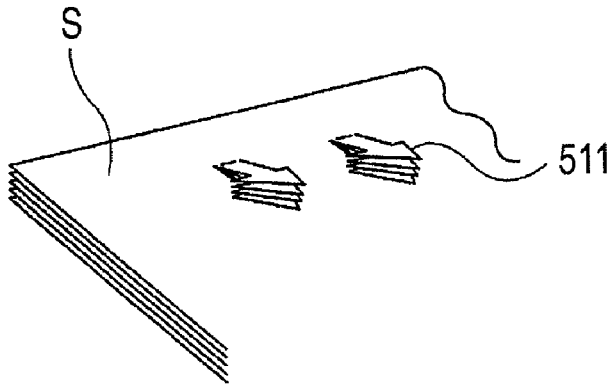
FIGS. 11A and 11B are explanatory views each explaining a bundle of sheets processed by stable-less binding processing according to other exemplary embodiments.
Figure 11B:
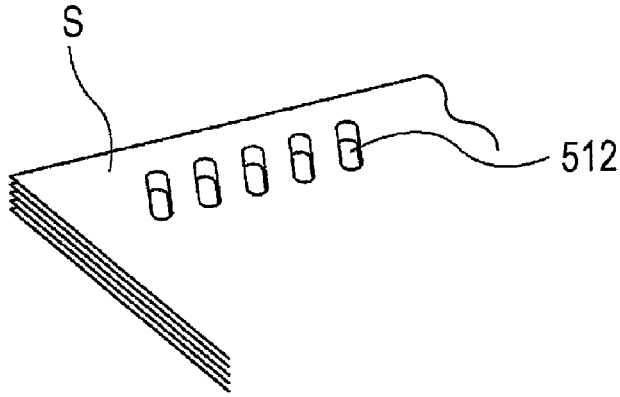

Now, other exemplary embodiments of the staple-less binding mechanism 50 are described with reference to FIGS. 11A and 11B. FIGS. 11A and 11B are explanatory illustrations each explaining a bundle of sheets after staple-less binding processing is performed according to other exemplary embodiments. FIG. 11A illustrates an exemplary embodiment for binding processing by making cuts with substantially arrow-like shapes. FIG. 11B illustrates an exemplary embodiment for binding processing by embossing to form embossed marks 512.

In the exemplary embodiment of binding shown in FIG. 11A, substantially arrow-like cuts 511 are formed in part of a bundle of sheets S. The substantially arrow-like cuts 511 are punched such that ends of bar parts remain and are arranged continuously from the sheets S. The substantially arrow-like cuts 511 are bent upward and the bent arrow-like cuts 511 engage with the hole. Thus, the bundle of sheets S is retained.

In contrast, in the exemplary embodiment of binding shown in FIG. 11B, the embossed marks 512 are formed in part of a bundle of sheets S. Thus, the bundle of sheets S is bound. In particular, a member that forms the embossed marks 512 is pressed from the upper surface in the drawing of the bundle of sheets S shown in FIG. 11B toward the opposite surface of the bundle of sheets S. Accordingly, recesses are formed in the surface where the bundle of sheets S shown in FIG. 11B is observed (i.e., protrusions are formed in the opposite surface). Thus, binding processing is performed.

Further, in the above-described exemplary embodiment, as shown in FIG. 5, the stapler 45 and the staple-less binding mechanism 50 of the binding device 40 respectively have heads, and the head of the stapler 45 is rotated (see arrow B in FIG. 5). However, it is not limited thereto. For example, the stapler 45 and the staple-less binding mechanism 50 may have a single head, and only a member that is included in the stapler 45 and pushes the staple 41 into the sheets may be rotated.

Further, in the above-described exemplary embodiment, the binding device 40 includes the single stapler 45 and the single staple-less binding mechanism 50. However, it is not limited thereto. For example, the binding device 40 may include two staplers 45, and the staple-less binding mechanism 50 may be provided between the two staplers 45. With this configuration, the staple 41 may be obliquely arranged at a corner part that is a corner part near the first end part Sa of the sheet S and is different from the corner part Se.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming unit that forms images on sheets;

a stack portion on which the sheets with the images formed by the image forming unit are stacked as a bundle of the sheets such that first end parts of the sheets are aligned;

a first binding unit that binds the first end parts of the bundle of sheets stacked on the stack portion;

a second binding unit that binds the first end parts of the bundle of sheets stacked on the stack portion, by a binding method that requires a binding region larger than a binding region of the first binding unit; and a distance reducing unit that changes a position of the bundle of sheets when the bundle of sheets is bound by the first binding unit, from a position of the bundle of sheets when the bundle of sheets is bound by the second binding unit, and reduces a distance between a part bound by the second binding unit and the first end parts as compared with a distance between a part bound by the first binding unit and the first end parts.

2. The image forming apparatus according to claim 1, wherein the distance reducing unit determines the distance between the part bound by the second binding unit and the first end parts so as to be a predetermined distance or larger in accordance with a strength of the sheets.

3. The image forming apparatus according to claim 1, wherein the second binding unit forms a partially punched sheet piece in the sheets such that part of the partially punched sheet piece is coupled to the sheets, forms a cut, and inserts an end part of the partially punched sheet piece into the cut.

4. The image forming apparatus according to claim 2, wherein the second binding unit forms a partially punched sheet piece in the sheets such that part of the partially punched sheet piece is coupled to the sheets, forms a cut, and inserts an end part of the partially punched sheet piece into the cut.

5. The image forming apparatus according to claim 1, wherein the stack portion includes an alignment member that aligns the first end parts, and wherein the distance reducing unit changes the distance between the part bound by the first binding unit and the first end parts, from the distance between the part bound by the second binding unit and the first end parts, by moving the alignment member.

6. The image forming apparatus according to claim 2, wherein the stack portion includes an alignment member that aligns the first end parts, and wherein the distance reducing unit changes the distance between the part bound by the first binding unit and the first end parts, from the distance between the part bound by the second binding unit and the first end parts, by moving the alignment member.

7. The image forming apparatus according to claim 3, wherein the stack portion includes an alignment member that aligns the first end parts, and wherein the distance reducing unit changes the distance between the part bound by the first binding unit and the first end parts, from the distance between the part bound by the second binding unit and the first end parts, by moving the alignment member.

8. The image forming apparatus according to claim 4, wherein the stack portion includes an alignment member that aligns the first end parts, and wherein the distance reducing unit changes the distance between the part bound by the first binding unit and the first end parts, from the distance between the part bound by the second binding unit and the first end parts, by moving the alignment member.

9. The image forming apparatus according to claim 1, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

10. The image forming apparatus according to claim 2, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

11. The image forming apparatus according to claim 3, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

12. The image forming apparatus according to claim 4, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

13. The image forming apparatus according to claim 5, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

14. The image forming apparatus according to claim 6, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

15. The image forming apparatus according to claim 7, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

16. The image forming apparatus according to claim 8, further comprising a distance changing unit that changes a distance between the first end parts of the sheets and an end of an image, the end which is located close to the first end parts, when the bundle of sheets is bound by the first binding unit, from a distance between the first end parts of the sheets and the end of the image when the bundle of sheets is bound by the second binding unit.

17. An image forming method, comprising:

forming images on sheets;

stacking the sheets with the images formed as a bundle of the sheets such that first end parts of the sheets are aligned;

performing first binding processing of binding the first end parts of the bundle of stacked sheets;

performing second binding processing of binding the first end parts of the bundle of stacked sheets, by a binding method that requires a binding region larger than a binding region of the first binding processing; and changing a position of the bundle of sheets when the bundle of sheets is bound by the first binding processing, from a position of the bundle of sheets when the bundle of sheets is bound by the second binding processing, and reducing a distance between a part bound by the second binding processing and the first end parts as compared with a distance between a part bound by the first binding processing and the first end parts.

* * * * *